US006429593B1

(12) United States Patent
Stegmaier et al.

(10) Patent No.: US 6,429,593 B1
(45) Date of Patent: Aug. 6, 2002

(54) LIGHTING DEVICE

(75) Inventors: Klaus-Dieter Stegmaier, Viechtach; Wilfried Brauckmann, Wendeburg, both of (DE)

(73) Assignee: Arnold & Richter Cine Technik GmbH & Co. Betriebs, KG DE, Munich (DE)

( * ) Notice: Subject to any disclaimer, the term of this patent is extended or adjusted under 35 U.S.C. 154(b) by 0 days.

(21) Appl. No.: 09/787,655

(22) PCT Filed: Sep. 20, 1999

(86) PCT No.: PCT/DE99/03074

§ 371 (c)(1),
(2), (4) Date: Mar. 19, 2001

(87) PCT Pub. No.: WO00/18194

PCT Pub. Date: Mar. 30, 2000

(30) Foreign Application Priority Data

Sep. 18, 1998 (DE) ..... 198 44 293

(51) Int. Cl.[7] ..... H01J 13/46

(52) U.S. Cl. ..... 315/58; 315/62; 315/209 M; 362/221; 362/226

(58) Field of Search ..... 315/58, 82, 209 R, 315/209 M, 289, 291, DIG. 7, 62; 362/221, 226, 265

(56) References Cited

U.S. PATENT DOCUMENTS

| | | | | |
|---|---|---|---|---|
| 4,144,462 A | * | 3/1979 | Sieron et al. | 307/130 |
| 5,118,990 A | | 6/1992 | Makita | 315/77 |
| 5,132,884 A | | 7/1992 | Totten | 362/147 |
| 5,188,444 A | * | 2/1993 | Makita et al. | 362/265 |
| 5,691,603 A | | 11/1997 | Nilssen | 315/209 |
| 5,838,109 A | | 11/1998 | Kobayashi et al. | 315/58 |
| 5,998,936 A | * | 12/1999 | Nilssen | 315/209 R |

FOREIGN PATENT DOCUMENTS

| | | |
|---|---|---|
| DE | 33 23 930 | 1/1985 |
| DE | 40 39 689 | 6/1991 |
| DE | 41 08 006 | 9/1991 |
| DE | 43 01 184 | 7/1994 |
| DE | 195 09 860 | 9/1996 |
| DE | 196 45 752 | 5/1997 |

* cited by examiner

*Primary Examiner*—Haissa Philogene
(74) *Attorney, Agent, or Firm*—Christie, Parker & Hale, LLP

(57) ABSTRACT

A lighting device comprises a discharge lamp (7) which is connected to a ballast and starting device (1) either directly or via an electric cable (4). Alternatively said discharge lamp (7) can be mechanically and electrically coupled to an external starting device (5) and electrically connected to the ballast and starting device (1) via a connecting cable (4).

15 Claims, 5 Drawing Sheets

9
11
2,6
10

LIGHTING DEVICE

CROSS-REFERENCE TO RELATED APPLICATION

This application claims priority of International application number PCT/DE99/03074, filed Sep. 20, 1999, which in turn claims priority to German patent application number 198 44 293.9, filed Sep. 18, 1998.

BACKGROUND

The invention relates to a lighting device.

By contrast with incandescent lamps, discharge lamps have the advantage of a substantially higher light yield and/or economic efficiency. The operation of discharge lamps requires a ballast and a starting device, of which the starting device provides the starting voltage required for starting the gas discharge, whereas the ballast limits the lamp current of the discharge lamp during its operation after it has been started.

The starting voltage must overcome the resistance in the discharge lamp, and is proportional to the prevailing gas pressure. It can be up to 50 kV, but must be present only briefly as a high-voltage pulse.

After the discharge lamp has been started, resistance decreases inside the discharge lamp, and the lamp current, previously very low, can rise to impermissibly high values owing to the negative resistance characteristic of the ionized gas. A ballast with a positive current-voltage characteristic is therefore necessary to limit the current. Ballasts can be constructed as inductor ballasts or as electronic ballasts, it being impossible to achieve a robust design, a high operational reliability and ease of use with inductor ballasts. However, they require a relatively large lamp installation space, cannot compensate the lamp tolerances and changes in system voltage, and are relatively heavy.

Electronic ballasts compensate fluctuations in system voltage and in frequency over a certain range, but are less robust and likewise require installation space and appropriate cooling devices, and entail additional weight.

The operation of a discharge lamp by means of a ballast and starting device is general prior art, and is described in DE 43 01 184 C2, for example.

Normally, ballast and starting device are accommodated in the housing of the lighting device, that is to say in the vicinity of the discharge lamp, since in the case of a large length of lead from the ballast and starting device to the discharge lamp excessively large losses occur and/or an excessively large voltage drop occurs, and so reliable operation of the discharge lamp is not ensured. However, the lighting device becomes very large and cumbersome when the ballast and starting device are connected to the discharge lamp.

A further disadvantage of the known lighting devices consists in that a dedicated ballast and/or starting device is required for each discharge lamp, and this leads to substantial costs when a plurality of discharge lamps are used.

U.S. Pat. No. 5,691,603 discloses the connection of a plurality of lighting units to a central power supply, with a rectifier connected to a voltage source and having a downstream smoothing circuit to which an inverter bridge circuit is connected as a starting circuit for a plurality of lighting units. A socket of the central power supply is connected via fuses to an output transformer of the inverter bridge circuit and can be connected to a plug which produces an electric connection to the socket of a first lighting unit via a connecting line. This first lighting unit includes a ballast transformer and a series inductor and a fluorescent lamp.

Also provided is a through line which connects the socket-contact of the first lighting unit via an output socket-contact fitted on the first lighting unit to a further lighting unit which likewise includes a ballast transformer, a series inductor and a fluorescent lamp.

This document does not indicate how a compact structural unit can be created between the discharge lamp and an external starting device, on the one hand, and the discharge lamp and a ballast and basic starting device, on the other hand.

DE 33 23 930 A1 discloses a ballast and starting device for a gas discharge lamp fed from an AC circuit, which combines power-independent switching elements, specifically a rectifier bridge circuit, a current-limiting capacitor, a rectifier multiplier circuit and a bipolar, electromagnetic current impulse changeover switch in a starting section housing, and power-dependent switching elements, specifically series-connected capacitors with parallel-connected smoothing capacitors and a discharge resistor in a nominal power section housing can be interconnected electrically and mechanically via plug-in contacts, it being possible to connect the discharge lamp with an upstream smoothing inductor to DC voltage outputs of the starting section housing.

SUMMARY

It is the object of the present invention to create a lighting device which can be used in a versatile fashion and even in the case of restricted available space, is of low weight and overall volume if required, ensures a compact, closed design, can be produced cost-effectively, and ensures stable operation which is insusceptible to interference.

The operation of the lighting device in various arrangements of a discharge lamp with a ballast and starting device widens the field of use of such lighting devices and also their ease of use, and permits cost-effective production and cost-effective operation of the lighting devices.

Since the discharge lamps are connected mechanically and electrically in a detachable fashion to the ballast and operating device, it is possible for different, and also a plurality of, discharge lamps to be operated simultaneously with one ballast and starting device.

A discharge lamp with small dimensions which can also be used at locations which are difficult to access is created by the mechanical and electrical coupling of the discharge lamp to an external starting device, which is connected via a connecting cable to the current-limiting circuit of a ballast and basic starting device in conjunction with bridging of the starting circuit of this device.

Since the discharge lamp is operated spatially separately from the ballast and basic starting device, the discharge lamp can be started independently of the relatively large and heavy ballast and thus has a low weight and can, in particular, advantageously be used in constricted space conditions. The transmission losses and voltage losses are minimized by the short spacing and the short line paths, associated therewith, between the discharge lamp and external starting device, thus ensuring reliable operation of the discharge lamp.

It is recommended in this case that when the discharge lamp is operated with an external starting device the adapter is used to produce a direct connection, avoiding the basic starting device, to the ballast by bridging the current-limiting circuit of the basic starting device. This can be done, for example, by an appropriate electric or electronic circuit arrangement, a switch or via a connect assignment of the adapter. In addition to low electric losses and to produce a closed structural unit between the external starting device and the discharge lamp, the external starting device can be fastened directly without further adapters on the discharge lamp, or on the housing of the discharge lamp.

In an advantageous development of the invention, the connection between the discharge lamp and housing of the ballast and basic starting device is implemented via an adapter, by means of which an interface is produced between the ballast and basic starting device and discharge lamp which is fixed and can be applied for a plurality of units. The adapter can be a separate component or integrated into one of the modules to be connected.

In one variant of the invention, a plurality of adapter connections are provided on the starting device so that a plurality of discharge lamps can be started with the aid of one starting device. Particularly in the case of electronic ballasts, it is possible for the lamp current of a plurality of discharge lamps to be controlled with the aid of a single ballast.

For reasons of easy assembly and of quick lamp changing, given that it is also possible to operate different discharge lamps on one external starting device, it is expedient for the external starting device to have an adapter connection of the ballast and basic starting device. It is possible in this way to operate the discharge lamp via an adapter connection both on the ballast and basic starting device and on the external starting device, without the need for structural changes or adapters.

It is favorable to be able to connect the connecting cable to the ballast at various points of the external starting device in the interest of the most variable use possible of the discharge lamp in the uncoupled mode. For this reason, the connecting cable has a plug which can be connected to a plurality of sockets of the external starting device.

An advantageous refinement of the solution according to the invention is characterized in that the sockets of the external starting device have different alignments or orientations. For example, one orientation is provided in the direction in which the lamp emits light, and one is provided at right angles to the direction in which the lamp emits light, in order to have as large a number as possible of options for combinations and arrangements in conjunction with the possible forms of plug, for example straight or right-angle plugs. Of course, other orientations relative to the direction of light emission or a main direction of expansion of the lamp housing are possible.

In accordance as well, it is advantageous for reasons of variability that the sockets and the adapter connections are compatible, so that, for example, a plurality of discharge lamps can be connected to a ballast by means of the external starting devices in different directions of light emission.

In one embodiment of the invention, the adapter connection or the sockets is constructed as a bayonet lock, the bayonet lock advantageously having a rotatable contact plate, in order not to damage the mechanical locking of the electric contacts.

The idea on which the invention is based is to be explained in more detail with the aid of exemplary embodiments illustrated in the drawing, in which:

DETAILED DESCRIPTION

Figure 1:
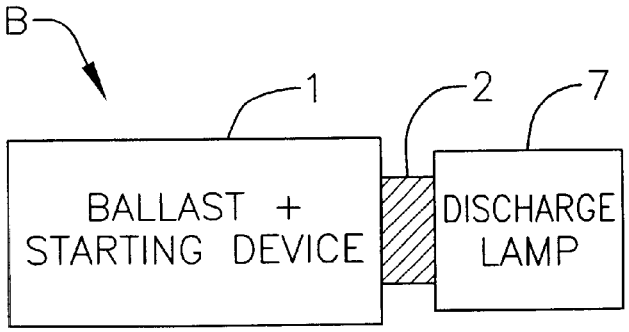
FIG. 1 shows a diagrammatic illustration of a discharge lamp with a coupled-on ballast and basic starting device.

FIG. 1 shows a diagrammatic illustration of a lighting device B having a ballast and basic starting device 1, on which a discharge lamp 7 is fastened. Although electrically the ballast and the basic starting device form two separate components, these are denoted jointly as ballast and basic starting device 1. If reference is made to one of the two components separately, these are denoted as ballast 1*a* and basic starting device 1*b*.

Arranged on the ballast and basic starting device 1 is an adapter or adapter connection 2 which is expediently integrated into the housing but, for reasons of clarity, has not been illustrated separately here.

The discharge lamp 7 together with the lamp housing is fastened via the adapter connection 2 in such a way as to produce the structural unit with the ballast and basic starting device 1. In this way, the lighting device B differs from conventional luminaires in having a modular design by means of which various discharge lamps 7 can be operated on a standard ballast and basic starting unit 1. The adapter or adapter connection 2 is constructed in this case in such a way that the discharge lamp 7 is permanently connected mechanically to the ballast and basic starting unit 1, such that it is possible to arrange the lighting device B on a stand or the like. The electric connection of the discharge lamp 7 to the ballast and basic starting device 1 is likewise performed via the adapter or adapter connection 2 by means of electric jacks or contact connectors which are integrated therein and make contact with corresponding mating sockets or mating connectors on the discharge lamp 7 or on the ballast and basic starting device 1 when the discharge lamp 7 and ballast and basic starting device 1 are connected mechanically.

Figure 2:
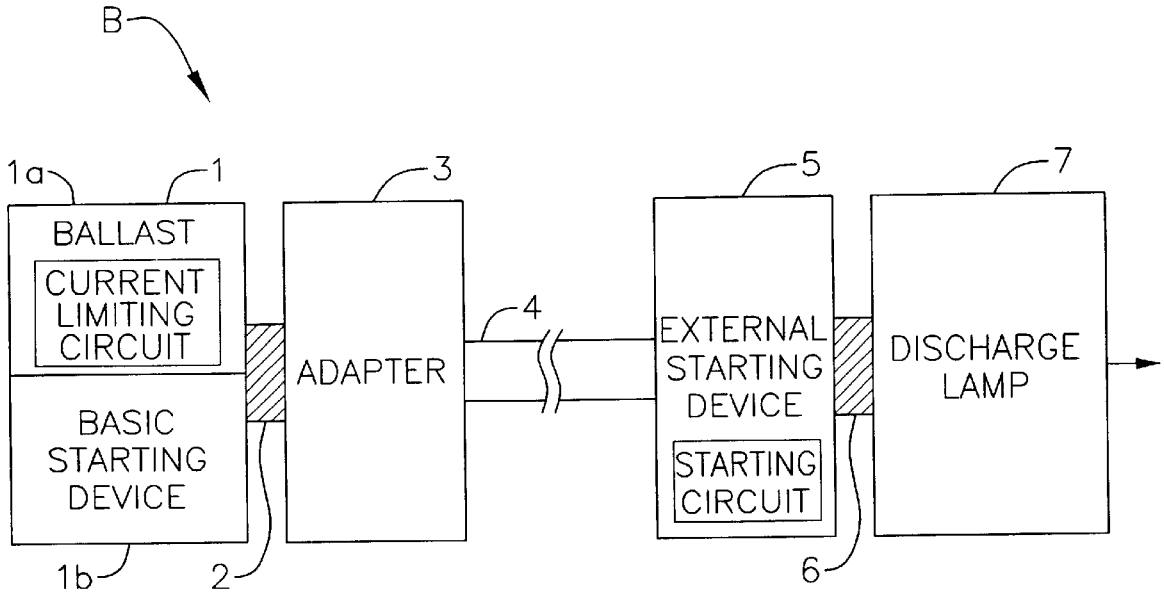
FIG. 2 shows a diagrammatic illustration of a discharge lamp having a coupled-on external starting device.

FIG. 2 shows a variant of the lighting device B, in the case of which there is connected at the adapter connection 2 of the ballast and starting device 1 an adapter 3 which is connected to an external starting device 5 via a connecting cable 4. The external starting device 5 has, for its part, an adapter or adapter connection 6 which can be coupled mechanically to an adapter of the discharge lamp 7 and via which the discharge lamp 7 can be connected electrically to the external starting device 5.

Since a starting device can be designed to be relatively small and light, the mobility or the field of use of the discharge lamp 7 is only insubstantially limited by a combination of the external starting device 5 with the discharge lamp 7. The direction in which the discharge lamp 7 emits light is indicated in FIG. 2 by the arrow, and this signifies that the external starting device 5 is connected at the rear side of the discharge lamp 7. A very narrow design can be achieved by this arrangement. However, it is also possible to place the external starting device 5 to the side of the discharge lamp 7 or on the lamp housing.

During operation it is expedient to use an external starting device 5 to produce a direct connection to the current-limiting circuit of the ballast 1*a* of the ballast and basic starting device 1, since the starting circuit of the basic starting device 1*b* is not required. Alternatively, it is also possible to bridge only the capacitor of the basic starting device 1*b*.

Since, in accordance with a further feature of the invention, the adapter or adapter connection at the discharge lamp 7 can also be directly coupled to an adapter or adapter connection of the connecting cable 4, it is also possible to produce a direct connection of the discharge lamp 7 to the adapter 3 of the ballast and basic starting device 1 without bridging the starting circuit of the ballast and basic starting device 1.

Figure 3:
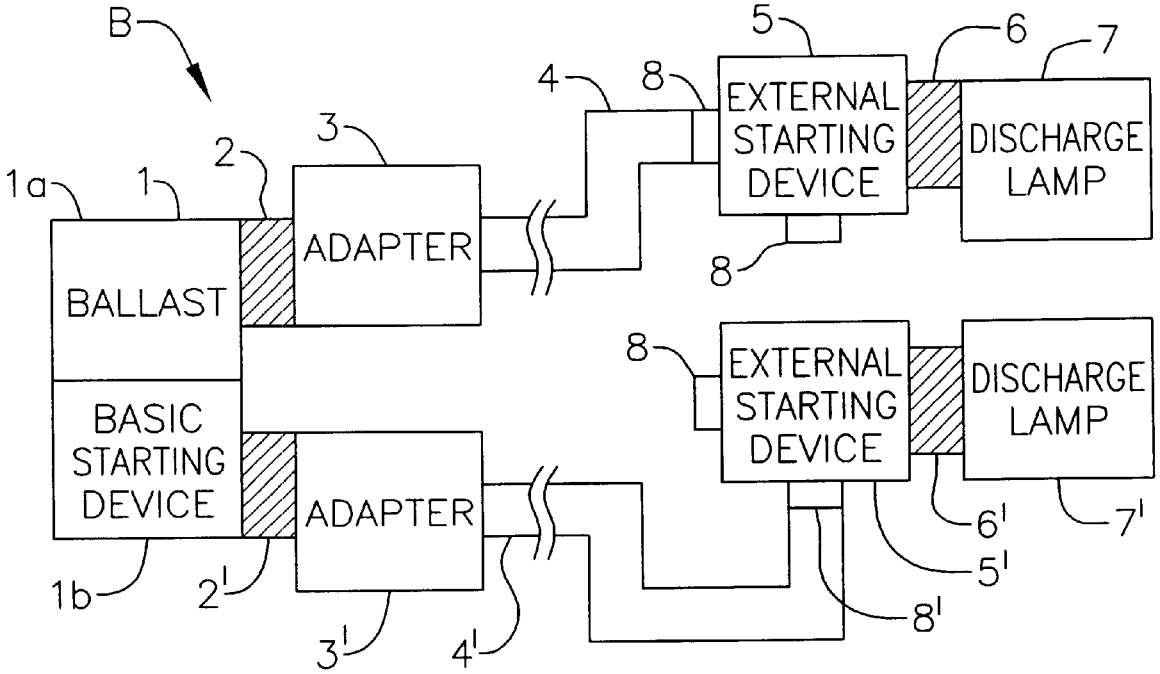
FIG. 3 shows a diagrammatic illustration of the operation of a plurality of discharge lamps each connected to one external starting device, on a ballast and basic starting device.

FIG. 3 shows the arrangement of a plurality of discharge lamps 7, 7', connected to external starting devices 5, 5', via cables 4, 4' and adapters 3, 3' and also adapter connections 2, 2' at a ballast and starting device 1. The design corresponds in principle to the design illustrated in FIG. 2, there being arranged here at the external starting devices 5, 5' two sockets 8, 8' to which one connecting cable 4, 4' each can be connected. These sockets 8, 8' can be arranged at different angular positions to the direction of light emission or to the lamp housing and/or to the external starting devices 5, 5'.

All forms of sockets are suitable in principle; for reasons of the modular design, it is to be recommended, however, to construct the sockets 8 in a fashion compatible with the adapter connections 2, since this creates a multiplicity of possible arrangements.

Figure 4B:
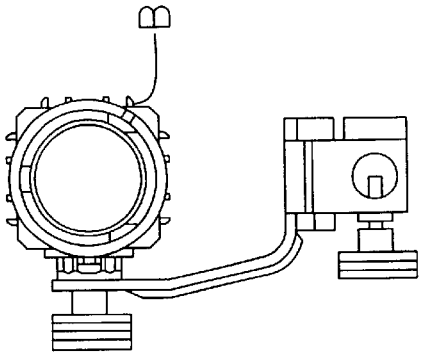
FIGS. 4A–C show a front view and side views of a discharge lamp connected mechanically and electrically to a ballast and basic starting device.
Figure 4C:
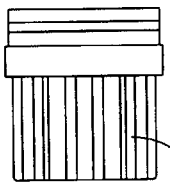
Figure 4A:
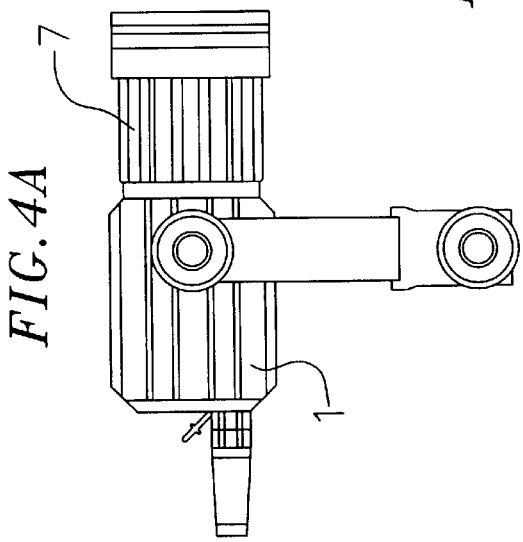

FIGS. 4A–C show a front view and side views of a discharge lamp 7 directly coupled mechanically and electrically to a ballast and basic starting device 1. The coupling is performed via an adapter with mechanical and electrical connecting elements on the ballast and basic starting device 1 and on the discharge lamp 7. In this exemplary embodiment, the ballast and basic starting device 1 has an articulation for connecting to a stand or to a suspension of the lighting device.

Figure 5B:
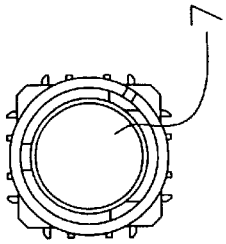
FIGS. 5A–B show a front view and a side view of a discharge lamp connected mechanically and electronically to an external starting device, and electrically to a ballast and basic starting device.
Figure 5A:
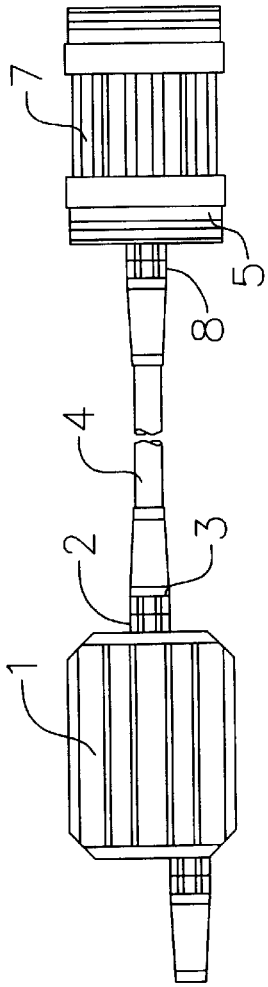
Figure 6C:
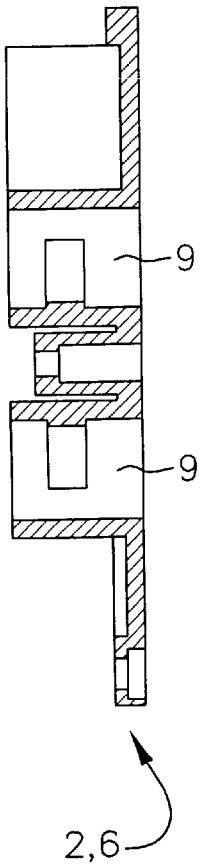
FIGS. 6A–C show a front view, a rear view and a section through a contact plate of an adapter or adapter connection.
Figure 6B:
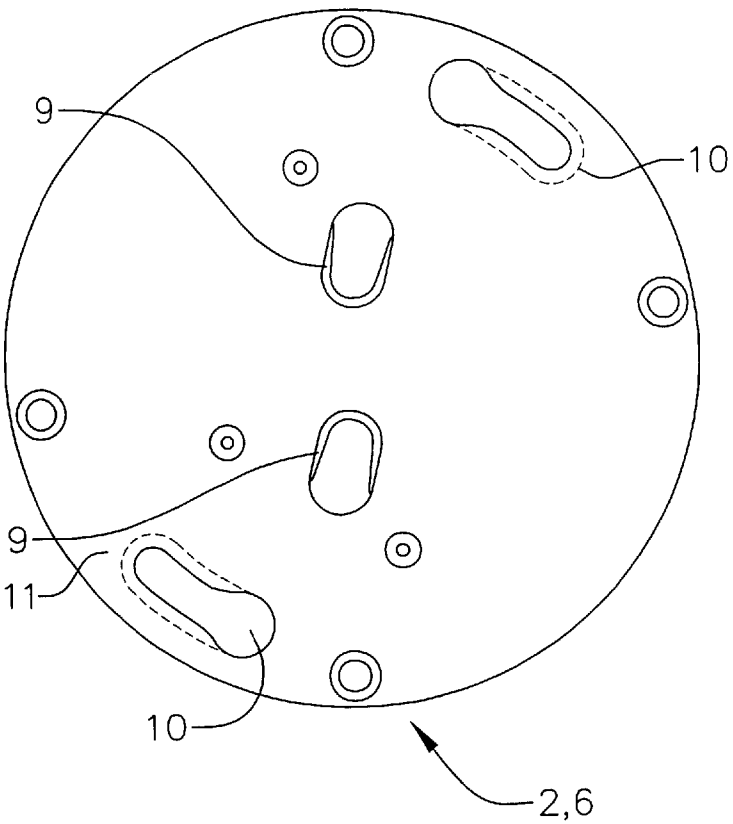
Figure 6A:
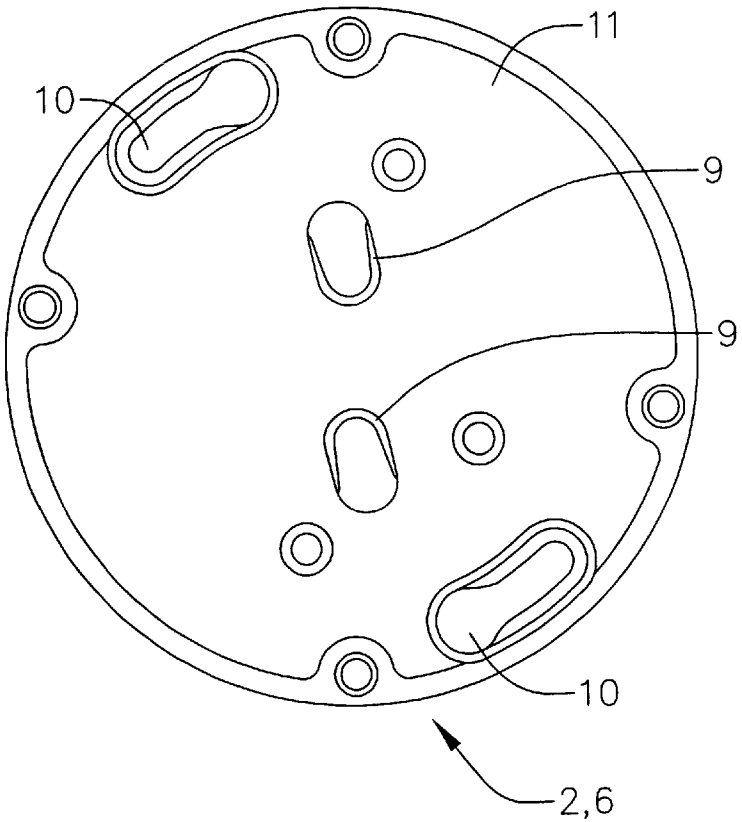
Figures 7A, 7B, 7C:
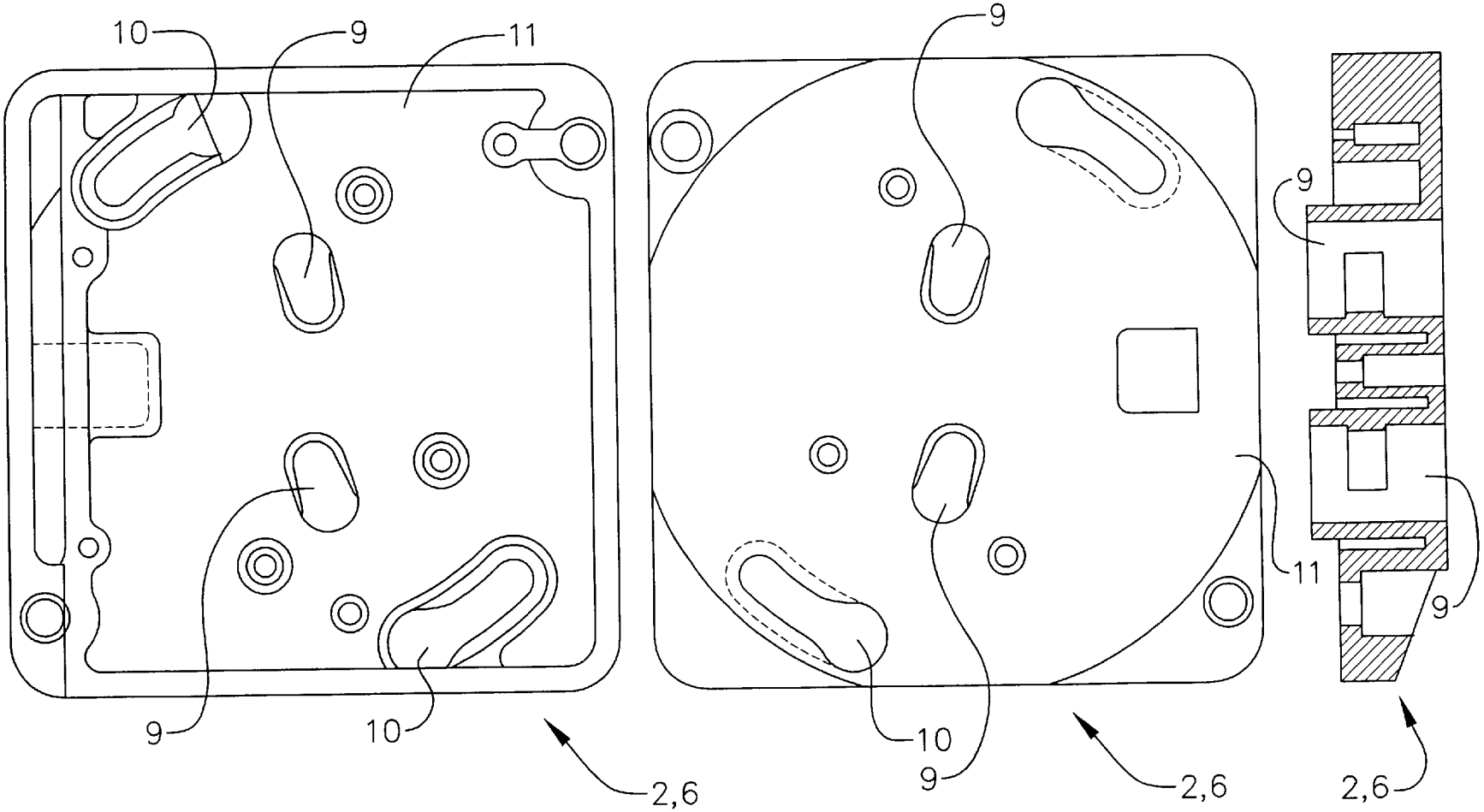
FIGS. 7A–C show a front view, a rear view and a section through a support plate of an adapter or adapter connection.

FIGS. 5A–B show a front view and a side view of a discharge lamp 7 connected mechanically and electrically to an external starting device 5, and a ballast and basic starting device 1 which is connected electrically to the external starting device 5 via a connecting cable 4. The length of the connecting cable 4 is 3.5 or 7 meters in a preferred embodiment.

Whereas in FIGS. 4A–C, for example, the total length of the lighting device formed from the ballast and basic starting device 1 and discharge lamp 7 is approximately 200 mm, the lighting device assembled in FIG. 5 from the discharge lamp 7 and external starting device 5 has a length of only approximately 96 mm.

The connection of the individual components of the lighting device (ballast and basic starting device 1, connecting cable 4, external starting device 5 and discharge lamp 7) can be performed via different types of sockets and adapters or adapter connections, depending on whether a purely electrical or electrical and mechanical connection is provided according to this subject matter of the invention. One design of the sockets 8 or adapter connections 2, 6 is the bayonet lock, in particular with a rotable contact plate, since this creates a reliable and quick mechanical and electrical connection without endangering the electric contacts.

FIGS. 6A–C and 7A–C illustrate various views of adapter connections 2, 6 which are constructed as bayonet locks and serve for the purpose of connecting the discharge lamp 7 to the external starting device 5, the ballast and basic starting device 1 or the connecting cable 4, and/or of connecting the connecting cable 4 to the external starting device 5 or the ballast and basic starting device 1.

In addition to the electric contacts 9, receptacles 10 for mechanical locking are provided on the adapter connection 2, 6. The mechanical locking is performed in this case in a known way by inserting fastening pins (not illustrated) into the receptacles 10, followed by rotation through a specific angle.

The respective electric contacts 9 are closed at the same time as the fastening pins are inserted into the receptacles 10. In order to avoid damaging the contacts during rotation, the contact or support plate 11 is rotably designed as a rotatable contact or support plate 11.

List of Reference Symbols

1 —Ballast and starting device
1*a*—Ballast
1*b*—Basic starting device
2—Adapter connection
3—Adapter
4—Connecting cable
5—External starting device
6—Adapter connection
7—Discharge lamp
8—Socket
9—Electric contact
10—Receptacles
11—Rotatable contact or support plate
B—Lighting device

What is claimed is:

1. A modular lighting device for theatre, film and studio lighting devices, the lighting device comprising:

a discharge lamp arranged in a lamp housing having a rear side with one of an adapter and an adapter connection, a ballast and basic starting device having a current-limiting circuit and a housing with one of an adapter and an adapter connection, an external starting device having a starting circuit and arranged in a housing with one of an adapter and an adapter connection, a connecting cable connecting the external starting device to the ballast and basic starting device, and wherein one of the adapter and the adapter connection of the lamp housing mechanically couples to one of the adapter and the adapter connection of the ballast and basic starting device and mechanically couples to one of the adapter and the adapter connection of the external starting device, such that a structural unit is produced, and wherein, upon coupling of the lamp housing to the housing of the external starting device, an electric connection of the discharge lamp to the starting circuit of the external starting device and to the current-limiting circuit of the ballast and basic starting device via the connecting cable is produced.

2. The lighting device according to claim 1, wherein the connecting cable is connected to one of the adapter and the adapter connection of the ballast and basic starting device via an adapter.

3. The lighting device according to claims 1 or 2, wherein the connecting cable has one of an adapter and an adapter connection and the discharge lamp is connected to the current-limiting circuit of the ballast and basic starting device via the adapter or adapter connection on the lamp housing and an adapter or adapter connection on the connecting cable.

4. The lighting device according to claim 1, wherein the ballast and basic starting device comprises a plurality of adapter connections for various discharge lamps.

5. The lighting device according to claim 1,wherein, during operation of the discharge lamp, the starting circuit of the ballast and basic starting device is bridged by the external starting device, and the current-limiting circuit of the ballast and basic starting device is connected to the discharge lamp via the external starting device.

6. The lighting device according to claim 1, wherein the adapter connections of the ballast and basic starting device housing and of the external starting device are compatible.

7. The lighting device according to claim 1, wherein the external starting device has at least two sockets for connecting to the connecting cable.

8. The lighting device according to claim 7, wherein the external starting device comprises a lateral surface and a rear surface; and the sockets are variously aligned and arranged on the lateral surface and on the rear surface, away from the discharge lamp, of the external starting device connected to the discharge lamp.

9. The lighting device according to claim 7 or 8, wherein the sockets and the adapter and the adapter connection of the ballast and basic starting device are compatible.

10. The lighting device according to claim 7, wherein the adapter connections have a rotatable contact plate and receptacles for mechanical connection to fastening pins of a mating adapter.

11. The lighting device according to claim 10, wherein the receptacles for mechanical connection to fastening pins are constructed as a bayonet lock.

12. A modular lighting device for theatre, film and studio lighting devices, the lighting device comprising:

a discharge lamp arranged in a lamp housing having a rear side with one of an adapter and an adapter connection, a ballast and basic starting device having a housing with one of an adapter and an adapter connection, an external starting device arranged in a housing with one of an adapter and an adapter connection, a connecting cable connecting the external starting device to the ballast and basic starting device, and wherein one of the adapter and the adapter connection of the lamp housing mechanically couples to one of the adapter and the adapter connection of the ballast and basic starting device, such that a structural unit is produced, and wherein, upon coupling of the lamp housing to the housing of the ballast and basic starting device, an electric connection of the discharge lamp to the ballast and basic starting device is produced.

13. The lighting device according to claim 12 wherein the connecting cable is connected to one of the adapter and the adapter connection of the ballast and basic starting device via an adapter.

14. The lighting device according to claims 13 wherein the ballast and basic starting device has a current-limiting circuit and the connecting cable has one of an adapter and adapter connection and the discharge lamp is connected to the current-limiting circuit of the ballast and basic starting device via the adapter or adapter connection on the lamp housing and the adapter or adapter connection on the connecting cable.

15. The lighting device according to claim 12 wherein the ballast and basic starting device comprises a plurality of adapter connections for various discharge lamps.

* * * * *